US010685799B2

(12) United States Patent
Sakai et al.

(10) Patent No.: US 10,685,799 B2
(45) Date of Patent: Jun. 16, 2020

(54) ELECTRIC CIRCUIT BREAKER DEVICE

(71) Applicant: DAICEL CORPORATION, Osaka-shi, Osaka (JP)

(72) Inventors: Toshiyuki Sakai, Tatsuno (JP); Tomohide Fujiwara, Tatsuno (JP)

(73) Assignee: DAICEL CORPORATION, Osaka-shi (JP)

( * ) Notice: Subject to any disclaimer, the term of this patent is extended or adjusted under 35 U.S.C. 154(b) by 0 days.

(21) Appl. No.: 16/314,095

(22) PCT Filed: Jun. 20, 2017

(86) PCT No.: PCT/JP2017/022630
§ 371 (c)(1),
(2) Date: Dec. 28, 2018

(87) PCT Pub. No.: WO2018/003593
PCT Pub. Date: Jan. 4, 2018

(65) Prior Publication Data

US 2019/0206645 A1 Jul. 4, 2019

(30) Foreign Application Priority Data

Jun. 29, 2016 (JP) ..... 2016-129098

(51) Int. Cl.
*H01H 33/04* (2006.01)
*H01H 39/00* (2006.01)
(Continued)

(52) U.S. Cl.
CPC ..... *H01H 39/006* (2013.01); *F42B 3/10* (2013.01); *H01H 33/04* (2013.01); *H01H 39/00* (2013.01);
(Continued)

(58) Field of Classification Search
CPC ..... H01H 39/006; H01H 71/12; H01H 33/04; H01H 2039/008; H01H 39/00; F42B 3/10
See application file for complete search history.

(56) References Cited

U.S. PATENT DOCUMENTS 6,222,439 B1 4/2001 Tanigawa et al.
2002/0166471 A1* 11/2002 Goernig ..... F42B 3/121 102/202.5
(Continued)

FOREIGN PATENT DOCUMENTS

DE 102006032605 A1 11/2007
EP 2660842 A1 11/2013
(Continued)

*Primary Examiner* — Truc T Nguyen
(74) *Attorney, Agent, or Firm* — Birch, Stewart, Kolasch & Birch, LLP.

(57) ABSTRACT

To provide an electric circuit breaker device that can be downsized while maintaining strength. An igniter 20, a bar-shaped projectile 40, a conductor piece 50, and an insulating space 61 are provided inside a resin housing 10. A cylinder 30 is disposed between the bar-shaped projectile 40 and an inner wall surface of the housing 10, and further, a reinforcing frame 70 is disposed in the housing 10 on the outer side. A discharge path for combustion products generated by actuation of the igniter 20 is provided between the insulating space 61 and a second end 12 of the housing.

19 Claims, 3 Drawing Sheets

(51) Int. Cl.
*F42B 3/10* (2006.01)
*H01H 71/12* (2006.01)

(52) U.S. Cl.
CPC ..... *H01H 71/12* (2013.01); *H01H 2039/008* (2013.01)

(56) References Cited

U.S. PATENT DOCUMENTS

| | | | | |
|---|---|---|---|---|
| 2002/0166473 | A1* | 11/2002 | Goernig | F42B 3/121 102/202.5 |
| 2005/0083164 | A1 | 4/2005 | Caruso et al. | |
| 2005/0083165 | A1 | 4/2005 | Tirmizi | |
| 2006/0135002 | A1* | 6/2006 | Imanishi | H01H 50/443 439/793 |
| 2012/0234162 | A1 | 9/2012 | Tirmizi | |
| 2013/0220095 | A1* | 8/2013 | Ukon | H01H 39/006 83/639.1 |
| 2014/0061161 | A1 | 3/2014 | Nakamura et al. | |
| 2014/0326122 | A1 | 11/2014 | Ukon et al. | |
| 2016/0343524 | A1* | 11/2016 | Gaudinat | H01H 39/006 |
| 2017/0221662 | A1* | 8/2017 | Sakai | H01H 39/006 |

FOREIGN PATENT DOCUMENTS

| | | | |
|---|---|---|---|
| JP | 11-232979 | A | 8/1999 |
| JP | 2000-90794 | A | 3/2000 |
| JP | 2013-138004 | A | 7/2013 |
| JP | 2014-49300 | A | 3/2014 |
| JP | 2016-85947 | A | 5/2016 |

* cited by examiner

[Fig.1]
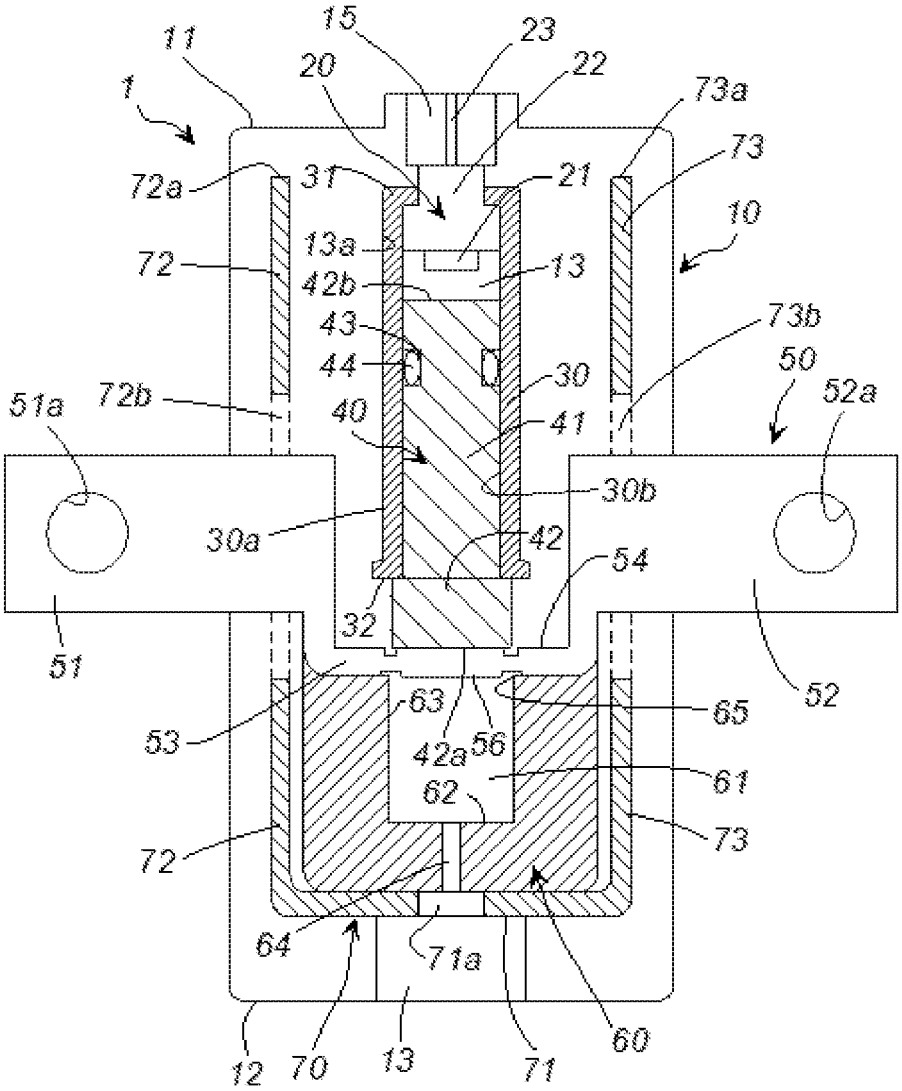

[Fig.2]
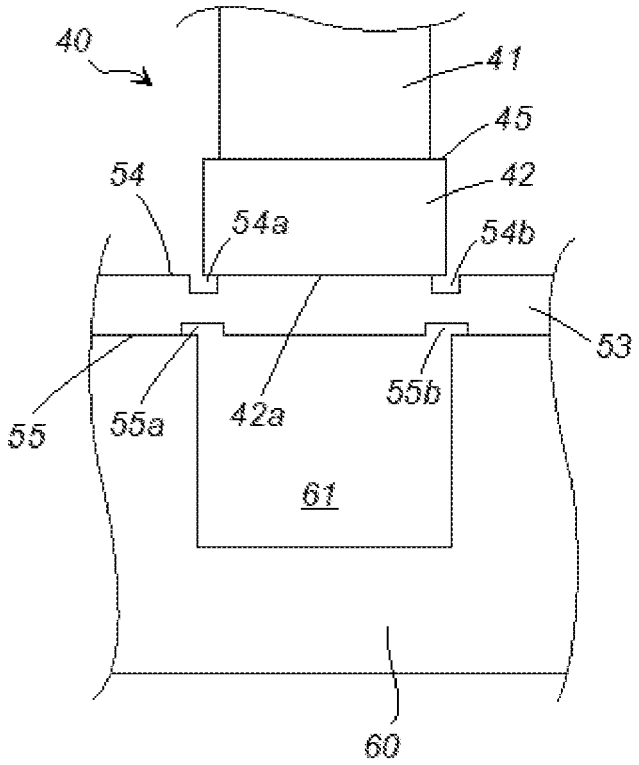
(a)
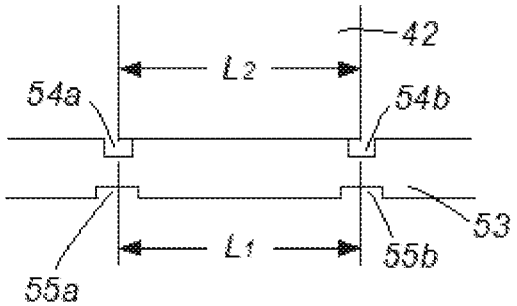
(b)

[Fig. 3]
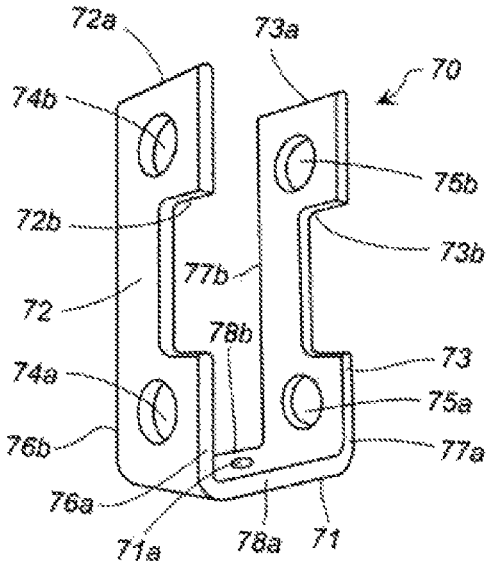
[Fig. 4]
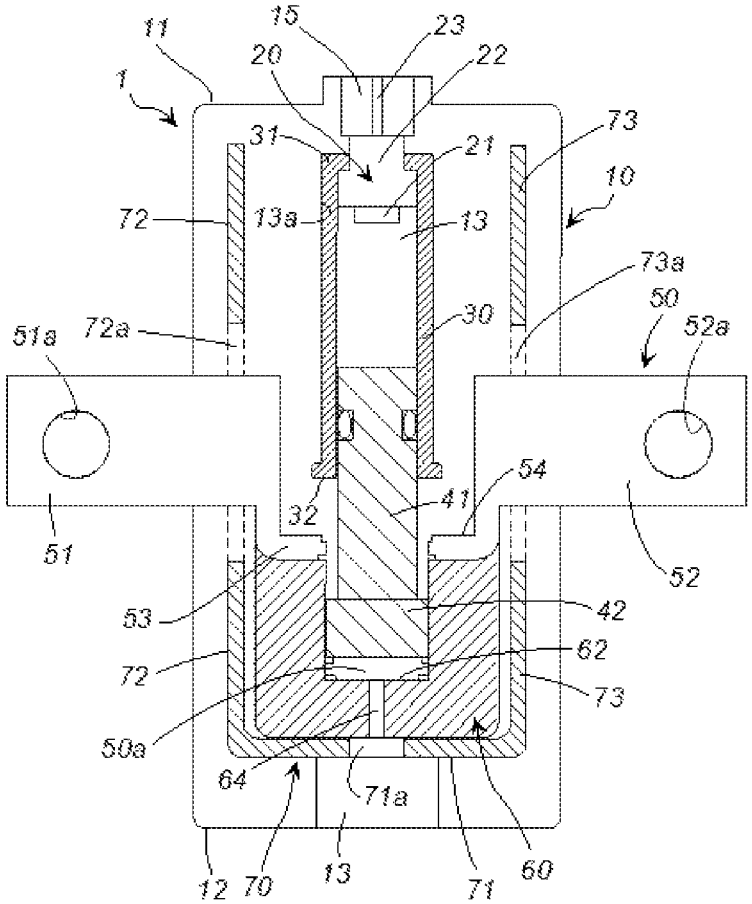

ELECTRIC CIRCUIT BREAKER DEVICE

FIELD OF THE INVENTION

The present invention relates to an electric circuit breaker device that can be used for an electric circuit of an automobile, home appliances, or the like.

BACKGROUND OF THE INVENTION

An electric circuit breaker device that breaks an electric circuit of an automobile, home appliances, or the like has been used to prevent severe damage at the time of an abnormality in the electric circuit itself or an entire system including the electric circuit. The importance of an electric circuit breaker device has become larger particularly in an electric circuit of an electric vehicle.

A known electric circuit breaker device contains, in a housing, an igniter, a projectile (piston), a conductor, and the like. References include US-A 2005/0083164 (Patent Literature 1), US-A 2005/0083165 (Patent Literature 2), US-A 2012/0234162 (Patent Literature 3), JP-A 11-232979 (Patent Literature 4), JP-A 2014-49300 (Patent Literature 5), and JP-A 2016-85947 (Patent Literature 6).

In Patent Literatures 1 and 2, metal, ceramic, and polymer are cited as examples of the material of a housing, and it is stated that a specific polymer is preferred (pages 2 and 3 of Patent Literature 1, and Page 2 of Patent Literature 2).

In Patent Literature 4, a casing 13 is made of stainless steel (paragraph No. 0011).

In Patent Literature 5, a case 30 has an electric insulation property, and is formed of a high-strength material (e.g., resin material) (paragraph No. 0034).

When a polymer material (resin material) is used, as is understood from FIG. 1 of each of Patent Literatures 1, 2, and 5, the housing (casing) needs to be formed thick to give necessary strength. When the stainless steel casing 13 is used as in Patent Literature 4, the mass increases, and since the casing 13 needs to be disposed in combination with an insulating case 14, the structure and assembly are complicated. Moreover, Patent Literature 4 is provided with an arc extinguishing chamber 32 for extinguishing an arc that occurs when an energized electrically conductive body is cut (Claims).

In Patent Literature 6, a metal cylinder is used to reinforce a resin housing, so that an effect unachievable in Patent Literatures 1 to 5 can be achieved.

SUMMARY OF THE INVENTION

An objective of the present invention is to provide an electric circuit breaker device that can be downsized as a whole while maintaining necessary strength, and can extinguish an arc even if an arc occurs when a conductor piece is cut.

In an embodiment, the present invention provides an electric circuit breaker device wherein: in a housing made of a synthetic resin, an igniter, a bar-shaped projectile made of a synthetic resin, and a conductor piece to form a part of an electric circuit are disposed in this order from a first end side of the housing to an axially opposite second end side of the housing; an insulating space is formed between the second end of the housing and the conductor piece;

the conductor piece is a plate piece comprising a first connection portion and a second connection portion at opposite ends and an intermediate cutting portion, with a surface of the cutting portion being disposed orthogonal to the axial direction of the housing;

the bar-shaped projectile is disposed to oppose the surface of the cutting portion of the conductor piece in the axial direction of the housing;

a cylinder is disposed between the bar-shaped projectile and an inner wall surface of the housing; and a discharge path for combustion products generated by actuation of the igniter is provided between the insulating space and the second end of the housing.

In another embodiment, the present invention provides an electric circuit breaker device wherein: in a housing made of a synthetic resin, an igniter, a bar-shaped projectile made of a synthetic resin, and a conductor piece to form a part of an electric circuit are disposed in this order from a first end side of the housing to an axially opposite second end side of the housing; an insulating space is formed between the second end of the housing and the conductor piece;

the conductor piece is a plate piece comprising a first connection portion and a second connection portion at opposite ends and an intermediate cutting portion, with a surface of the cutting portion being disposed orthogonal to the axial direction of the housing;

the bar-shaped projectile is disposed to oppose the surface of the cutting portion of the conductor piece in the axial direction of the housing;

a cylinder is disposed between the bar-shaped projectile and an inner wall surface of the housing;

a reinforcing frame is further disposed within the housing outside of the cylinder and the insulating space; and a discharge path for combustion products generated by actuation of the igniter is provided between the insulating space and the second end of the housing.

The electric circuit breaker device of the present invention can be attached and used in an electric circuit of an electric vehicle, a battery (e.g., lithium ion battery) of a gasoline or diesel automobile, and various electric circuits such as those for home appliances, and can break the electric circuit when an abnormality occurs in the electric circuit.

While the electric circuit breaker device of the present invention alone may be attached to various automobiles described above, it may be attached to work, for example, together with an airbag system installed in an automobile. In such a case, when the automobile provided with the airbag system causes an accident, the electric circuit breaker device of the present invention may actuate upon receipt of an actuation signal of the airbag system, and break the electric circuit to prevent leakage of a large current.

The housing is made of a synthetic resin, and the external shape is appropriately selected according to the attachment portion. The housing has a shape, structure, and size that allow storage and attachment of parts such as an igniter, a projectile, a cylinder, a conductor piece, and a reinforcing frame.

The igniter includes, in addition to an igniter used in a known electric circuit breaker device, igniters for generating gas used in an airbag system of an automobile. The igniter includes an ignition portion including an ignition charge, and a conduction pin for conducting electricity. At the time of actuation, the igniter combusts the ignition charge by applying electric power from an external power source, and generates combustion products such as combustion gas and flames.

The bar-shaped projectile (also referred to simply as projectile) is provided to move axially inside the housing upon receipt of pressure of the combustion products generated by actuation of the igniter, and cut the conductor piece to break the electric circuit. The tip end of the bar-shaped projectile may be in an arrowhead shape shown in 34 of FIG. 1 of Patent Literatures 1 and 2, or may be a flat surface as in piston 6 of FIG. 1 of Patent Literature 3. The bar-shaped projectile may be made of the same synthetic resin as the housing.

As for the conductor piece, those used in known electric circuit breaker devices may be used. The conductor piece is a plate piece including connection portions (first connection portion and second connection portion) at opposite ends and an intermediate cutting portion, and is provided to form a part of an electric circuit when attached to the electric circuit. The shape of the conductor piece is in a plate shape corresponding to the shape and structure of the attachment portion to the housing.

The cylinder is provided to reinforce the housing, and a cylinder selected from those made of metal such as stainless steel and aluminum, and a fiber reinforced resin such as a carbon-fiber reinforced resin can be used.

The inner wall surface of the housing and an outer circumferential surface of the cylinder are preferably in contact with each other. While the inner circumferential surface of the cylinder and the outer circumferential surface of the bar-shaped projectile may be in contact with each other, to facilitate moving at the time of actuation, a slight gap is preferably formed. Although the sectional shape in the width direction of the cylinder and the sectional shape of the bar-shaped projectile are preferably the same, the shape may partially differ.

In an electric circuit breaker device of an embodiment of the present invention, a reinforcing frame is disposed within the housing outside of the cylinder and the insulating space. The reinforcing frame may be embedded in the resin housing, or may be partially or entirely exposed on the surface of the resin housing.

When the electric circuit breaker device of the present invention is used as a device to break an electric circuit of an electric vehicle, a current flowing through the electric circuit is excessively large as compared to a current flowing through, for example, a battery of a gasoline-powered vehicle. Hence, a larger conductor piece is used in the electric circuit breaker device, and to give strength and durability necessary for the device, the resin housing part needs to be enlarged, whereby the device is enlarged as a whole. However, in the electric circuit breaker device of the present invention, the housing is reinforced by the cylinder, and/or the reinforcing frame is disposed within the housing outside of the cylinder and the insulating space, so that sufficient strength is given. Accordingly, the resin housing does not need to be enlarged, and the device can be downsized as a whole.

As the reinforcing frame, a frame selected from those made of metal such as stainless steel and aluminum, and fiber reinforced resin such as carbon-fiber reinforced resin can be used.

The circuit breaker of the present invention has a discharge path for combustion products between the insulating space and the second end of the housing. The discharge path for combustion products is a discharge path for discharging, to the outside, a part of the combustion products including combustion gas generated by actuation of the igniter.

In the device of the present invention, when the igniter is actuated, the projectile moves in the axial direction, and after the tip end of the projectile collides with the cutting portion of the conductor piece and cuts the cutting portion, the tip end and the cut piece enter the insulating space. Since the cutting portion is cut in this manner, the electric connection is interrupted, and the electric circuit is broken.

When the cutting portion is cut in this manner, an arc may be generated in the insulating space due to an electric potential difference that may occur between the first connection portion and the second connection portion left without being cut. When an arc is generated in the insulating space in this manner, the conducted state may be maintained, or peripheral members of the first connection portion and the second connection portion may be fused. However, in the device of the present invention, even when an arc is generated in the insulating space as mentioned above, the arc is promptly extinguished in the course of the combustion products generated by actuation of the igniter passing through the discharge path and being discharged to the ambient air. Hence, the above problem does not occur.

In the electric circuit breaker device of the present invention, when the reinforcing frame is provided, preferably, the reinforcing frame is U-shaped or similarly shaped in plan, and has a base plate including a gas passage hole penetrating in a thickness direction, and a first side plate and a second side plate extending in the same direction from lengthwise opposite ends of the base plate, the reinforcing frame is disposed to outwardly surround the insulating space and the cylinder with spacing, such that the base plate is in the second end side of the housing, and a tip end of the first side plate and a tip end of the second side plate are in the first end side of the housing, and the gas passage hole of the base plate forms a part of the discharge path for combustion products.

The reinforcing frame has the plate-shaped base plate, the plate-shaped first side plate, and the plate-shaped second side plate. The base plate has a gas passage hole penetrating therethrough in the thickness direction, and the gas passage hole forms a part of the discharge path for combustion products.

The first side plate and the second side plate face each other with the base plate interposed therebetween, and the first side plate and the second side plate preferably extend while maintaining a uniform gap therebetween. For example, the first side plate and the second side plate extend parallel to each other from respective ends of the base plate.

The reinforcing frame is U-shaped or similarly shaped in plan. For example, the reinforcing frame may have a U shape or a similar shape in a plane passing through all of the base plate and the first and second side plate. Shapes similar to a U shape include a shape in which corner portions between the base plate and side plates are not curved and are sharp (e.g., a shape formed of three sides of a quadrangle in plan view), a shape in which a gap between the first side plate and the second side plate gradually increases toward the tip end, and a shape in which the gap between the first side plate and the second side plate gradually decreases toward the tip end.

In the electric circuit breaker device of the present invention, when the reinforcing frame is provided, preferably, the reinforcing frame is U-shaped or similarly shaped in plan, and has a base plate including a gas passage hole penetrating in a thickness direction, and a first side plate and a second side plate extending in the same direction from lengthwise opposite ends of the base plate, the first side plate is narrowed between the base plate and the tip end to have a first recess, and the second side plate is narrowed between the base plate and the tip end to have a second recess, the first recess and the second recess being formed at opposing positions, the reinforcing frame is disposed to outwardly surround the insulating space and the cylinder with spacing, such that the base plate is in the second end side of the housing, a tip end of the first side plate and a tip end of the second side plate are in the first end side of the housing, and further, the first connection portion and the second connection portion of the conductor piece extend across the first recess and the second recess, and the gas passage hole of the base plate forms a part of the discharge path for combustion products.

The reinforcing frame has the plate-shaped base plate, the plate-shaped first side plate, and the plate-shaped second side plate. The base plate has a gas passage hole penetrating therethrough in the thickness direction, and the gas passage hole forms a part of the discharge path for combustion products.

The first side plate and the second side plate face each other with the base plate interposed therebetween, and the gaps formed therebetween are preferably spaced evenly. For example, the first side plate and the second side plate extend parallel to each other from respective ends of the base plate.

The reinforcing frame is U-shaped or similarly shaped in plan. For example, the reinforcing frame may have a U shape or a similar shape in a plane passing through all of the base plate and the first and second side plates. Shapes similar to a U shape include a shape in which corner portions between the base plate and side plates are not curved and are sharp (e.g., a shape formed of three sides of a quadrangle in plan view), a shape in which a gap between the first side plate and the second side plate gradually increases toward the tip end, and a shape in which the gap between the first side plate and the second side plate gradually decreases toward the tip end.

The first recess of the first side plate is a part where the first side plate is partially cut out in a rectangle or a half-oval shape (shape in which oval is split in half in the long-axis direction), for example. The first recess is preferably formed in a part including the center in the length direction of the first side plate.

The second recess of the second side plate is a part where the second side plate is partially cut out in a rectangle or a half-oval shape (shape in which oval is split in half in the long-axis direction), for example. The second recess is preferably formed in a part including the center in the length direction of the second side plate.

The conductor piece is disposed such that the first connection portion and the second connection portion respectively extend across the first side plate and the second side plate. At this time, to avoid contact between the conductor piece and the first side plate and second side plate, the width of the first side plate and the width of the second side plate need to be narrowed. When the width of the first side plate and the width of the second side plate are narrowed, the reinforcement effect of the reinforcing frame decreases.

By using the first side plate having the first recess and the second side plate having the second recess and disposing the first connection portion and the second connection portion of the conductor piece to respectively extend across the first recess and the second recess, not only can the contact between the conductor piece and the first side plate and second side plate be avoided, but also the part of the first side plate excluding the first recess can be widened, and the part of the second side plate excluding the second recess can be widened. Hence, decrease in the reinforcement effect of the reinforcing frame can be suppressed.

In the electric circuit breaker device of the present invention, when the reinforcing frame is provided, preferably, a hole penetrating in the thickness direction is provided in a part of the first side plate excluding the first recess, and in a part of the second side plate excluding the second recess. Since the part of the first side plate excluding the first recess and the part of the second side plate excluding the second recess are widened, a through hole is formed therein to reduce weight without decreasing the strength of the reinforcing frame. Although the shape of the hole is not particularly limited, to prevent cracking from corner portions, a circle or an oval having round inner circumferences are preferable.

In the electric circuit breaker device of the present invention, the cutting portion of the conductor piece preferably has a fragile portion in at least one of a surface in the first end side and a surface in the second end side. It is preferable that the cutting portion of the conductor piece has a fragile portion, since this facilitates breaking by the projectile at the time of actuation. The fragile portion is a groove, a damage, a thin portion, or the like.

In the electric circuit breaker device of the present invention, preferably, the cutting portion of the conductor piece has a first fragile portion in the first surface on the first end side, and a second fragile portion in the second surface on the second end side, and of the first surface having the first fragile portion and the second surface having the second fragile portion, the second surface has a smaller strength.

It is preferable that the cutting portion of the conductor piece has a fragile portion on both sides, since this facilitates breaking by the projectile at the time of actuation. Note, however, that when a fragile portion is formed on both sides of the cutting portion of the conductor piece, the strength of the conductor piece decreases. Hence, it is preferable that the breaking is facilitated after ensuring the strength of the conductor piece, by allowing a difference between the strengths of the first fragile portion in the first surface and the second fragile portion in the second surface. For example, if the fragile portion is a groove, the strengths can be adjusted by making the groove depth of the first fragile portion shallower than the groove depth of the second fragile portion, or making the groove width of the first fragile portion narrower than the groove width of the second fragile portion.

In the electric circuit breaker device of the present invention, the cylinder, and, depending on the embodiment, the reinforcing frame are disposed inside the housing made of a synthetic resin for reinforcement. Accordingly, the thickness of the housing can be reduced while maintaining necessary strength, and the device can be downsized as a whole.

Moreover, the electric circuit breaker device of the present invention has the discharge path for combustion products provided between the insulating space and the second end of the housing. Hence, an arc can be extinguished even if an arc is generated when the conductor piece is cut during actuation.

BRIEF DESCRIPTION OF DRAWINGS

FIG. 1 is an axial section of an electric circuit breaker device of the present invention.

FIG. 2 Parts (a) and (b) of FIG. 2 are partial enlargements of FIG. 1.

FIG. 3 is a perspective view of a reinforcing frame.

FIG. 4 is an axial section of the electric circuit breaker device of FIG. 1 after actuation.

EMBODIMENTS OF THE INVENTION

An embodiment of an electric circuit breaker device 1 of the present invention will be described with reference to FIGS. 1 and 2. A housing (resin housing) 10 made of a synthetic resin has a cylindrical space 13 that penetrates from a first end 11 to a second end 12. A connector fitting portion 15 that is connected with a power source by a lead wire during use is attached on the first end 11 side.

An igniter 20, a projectile 40 made of a synthetic resin, and a conductor piece 50 are disposed in this order in the axial direction from the first end 11 side, in a cylindrical space 13 of the housing 10. The igniter 20 has an ignition portion 21, and a resin portion 22 in which the igniter itself having a conductive pin 23 is partially surrounded by a resin, the ignition portion 21 protruding from the resin portion 22.

The projectile 40 shown in FIG. 1 may adopt the same configuration as that shown in FIG. 1 and part (a) of FIG. 2 of JP-A 2016-85947. The projectile 40 has a rod 41, and a tip end enlarged-diameter portion 42 formed on the tip of the rod 41. The outer diameter of the tip end enlarged-diameter portion 42 is larger than the outer diameter of the rod 41.

The sectional shape in the width direction (direction that crosses the axial direction) of the rod 41 is a circle, and the sectional shape in the width direction of the tip end enlarged-diameter portion 42 is a quadrangle (preferably a square) or a circle, and is more preferably a square.

The rod 41 has a neck portion 43 where the outer diameter is partially reduced, and an O-ring 44 made of rubber (e.g., silicon rubber) or a synthetic resin is fitted into the neck portion 43. Compared to the outer diameter of the rod 41, the outer diameter of the part where the O-ring 44 is fitted is slightly larger.

Note that the neck portion 43 and the O-ring 44 may be omitted from the present invention to more easily ensure a discharge path for combustion products at the time of actuation. Instead, a neck portion may be formed in an end surface 42*b* of the rod 41 facing the igniter 20 and an O-ring may be fitted thereinto, so that the O-ring may drop more easily at the time of actuation, and a discharge path for combustion products may be ensured more easily. An axially continuous groove as a vent hole may be formed between the rod 41 and the tip end enlarged-diameter portion 42. One groove, or two or more grooves may be formed.

The cylinder 30 shown in FIG. 1 is provided to reinforce the housing 10, and is made of metal such as stainless steel and aluminum, or fiber reinforced resin such as carbon-fiber reinforced resin.

Although the thickness of the cylinder 30 varies depending on the size of device 1, the range is preferably about 0.5 to 3 mm. An outer surface 30*a* of the cylinder 30 is brought into contact with an inner wall surface 13*a* of a cylindrical space 13. Of the cylinder 30, a first end opening 31 side abuts on the resin portion 22 of the igniter 20, while a second end opening 32 side on the opposite side abuts on an annular stepped face 45 (part (a) of FIG. 2) of the projectile 40.

The cylinder 30 surrounds the ignition portion 21 of the igniter 20 and the rod 41 of the projectile 40. At this time, the O-ring 44 fitted into the neck portion 43 of the projectile 40 is in contact with an inner circumferential surface 30*b* of the cylinder 30, but an outer surface of the rod 41 and the inner circumferential surface 30*b* of the cylinder 30 are not in contact with each other. The cylinder 30 is press-fitted into the cylindrical space 13 to be fixed and restricted from moving in the axial direction.

Note that the cylinder 30 may be fixed and restricted from moving in the axial direction by forming a claw portion in the outer surface 30*a* of the cylinder 30, forming a recess corresponding to the claw portion in a radially opposite inner wall surface (an inner wall surface 13*a* of the cylindrical space 13) of the housing 10, and fitting the claw portion into the recess at the time of attachment.

The conductor piece 50 is provided to form a part of an electric circuit when the device 1 is attached to the electric circuit. The conductor piece 50 is a plate piece (plate-shaped part) made up of a first connection portion 51 and a second connection portion 52 at opposite ends and an intermediate cutting portion 53.

The first connection portion 51 and the second connection portion 52 are provided to connect with another conductor (e.g., lead wire) in the electric circuit, while the cutting portion 53 is provided to break the electric circuit by being cut at the time of actuation.

As shown in part (a) of FIG. 2, the cutting portion 53 has two first fragile portions 54*a* and 54*b* formed in a first surface 54 on the first end 11 side, and two second fragile portions 55*a*, 55*b* formed in a second surface 55 on the second end 12 side.

The first fragile portions 54*a* and 54*b* are grooves formed in the width direction (direction perpendicular to the paper plane of FIG. 2) of the cutting portion 53, and having the same depths, widths, and lengths. The second fragile portions 55*a* and 55*b* are grooves formed in the width direction of the cutting portion 53, and having the same depths, widths, and lengths. The groove width of the first fragile portions 54*a* and 54*b* is narrower than the groove width of the second fragile portions 55*a* and 55*b*.

The first fragile portions 54*a* and 54*b* are respectively formed in positions facing the second fragile portions 55*a* and 55*b* in the thickness direction of the cutting portion 53. The center axis (center of groove width) of the first fragile portion 54*a* coincides with the center axis (center of groove width) of the second fragile portion 55*a*, while the center axis (center of groove width) of the first fragile portion 54*b* coincides with the center axis (center of groove width) of the second fragile portion 55*b*.

As shown in part (b) of FIG. 2, a length between the center axis of the first fragile portion 54*a* and the center axis of the first fragile portion 54*b* (L1) and a length of the tip end enlarged-diameter portion 42 of the projectile 40 (length of one side if the tip end enlarged-diameter portion 42 is a square) (L2) are the same (L1=L2).

A hole 51*a* in the first connection portion 51 and a hole 52*a* in the second connection portion 52 are both provided to connect with another conductor (e.g., lead wire) in the electric circuit.

Although in the conductor piece 50 of FIG. 1 the surface of the cutting portion 53 is orthogonal to the surfaces of the first connection portion 51 and the second connection portion 52, the surface of the cutting portion 53 may form the same plane as the surfaces of the first connection portion 51 and the second connection portion 52. That is, although the conductor piece 50 of FIG. 1 may be formed such that the part of the cutting portion 53 is bent toward the far side of the paper plane, the cutting portion 53 may instead be continuous with the first connection portion 51 and the second connection portion 52 to form one plate-shaped conductor piece.

Moreover, of the conductor piece 50, a part close to the cutting portion 53 of the first connection portion 51 and a part close to the cutting portion 53 of the second connection portion 52 may be deformed in the thickness direction, depending on the shape and structure of an attachment portion 56 of the housing 10.

The conductor piece 50 is disposed such that the surface of the cutting portion 53 is orthogonal to the axial direction of the housing 10. The first surface 54 of the cutting portion 53 of the conductor piece 50 on the first end 11 side faces the tip end surface 42*a* of the tip end enlarged-diameter portion 42 of the projectile 40. Although the first surface 54 of the cutting portion 53 and the tip end surface 42*a* abut on each other in FIG. 1, the parts may face each other with a gap in between.

Additionally, if the sectional shape of the tip end enlarged-diameter portion 42 of the projectile 40 in the width direction is a square, the length L2 of one side and the width (W1 (direction perpendicular to the paper plane of FIG. 2, not shown)) of the cutting portion 53 preferably satisfy relationship L2≥W1, and more preferably is within the range of L2/W1=1.0-1.2.

A box-shaped stopper 60 having one open surface and a bottom surface 62 as a surface facing the opening, is disposed between the conductor piece 50 and the second end 12 of housing, such that the opening side is on the conductor piece 50 side. The box-shaped stopper 60 is made of a synthetic resin, and the inside of the stopper 60 forms an insulating space 61.

The bottom surface 62 of the box-shaped stopper 60 has a discharge path 64 for combustion products which penetrates in the thickness direction and serves as a part of a discharge path for combustion products. The discharge path 64 may be formed in a side surface 63 of the box-shaped stopper 60. If the discharge path 64 for combustion products is formed in the bottom surface 62, the discharge path 64 is preferably formed in the center of the bottom surface 62. If the discharge path 64 for combustion products is formed in the side surface 63, the discharge path 64 is preferably formed on the bottom surface 62 side of the side surface 63.

A corner portion 65 of the opening of the box-shaped stopper 60 is positioned on the outer side of the center axis (center of groove width) of the second fragile portion 55*a* or 55*b*. Hence, the opening is larger than the distance between the center axes of the second fragile portions 55*a* and 55*b*.

At the time of actuation, the tip end enlarged-diameter portion 42 of the projectile 40 moves in the axial direction to cut the cutting portion 53 of the conductor piece 50, and then the tip end enlarged-diameter portion 42 and a cut piece 50*a* of the cutting portion 53 enter the insulating space 61, whereby the electric circuit is broken by cutting the cutting portion 53.

In the electric circuit breaker device 1 of FIG. 1, a stainless steel reinforcing frame 70 is disposed within the resin housing 10 outside of the cylinder 30. As shown in FIGS. 1 and 3, the reinforcing frame 70 is U-shaped in plan view, and has a base plate 71, and a first side plate 72 and a second side plate 73 extend in the same direction from lengthwise opposite ends of the base plate 71.

A gas passage hole 71*a* penetrates the base plate 71 in the thickness direction. The first side plate 72 is narrowed between the base plate 71 and the tip end 72*a* to have a first recess 72*b*. The second side plate 73 is narrowed between the base plate 71 and the tip end 73*a* to have a second recess 73*b*. The first recess 72*b* and the second recess 73*b* are recesses (parts from which the first side plate 72 and the second side plate 73 are cut out) having the same widths and lengths, and are formed at opposing positions.

In parts of the first side plate 72 excluding the first recess 72*b* (parts on both sides of the first recess 72*b* in length direction), two circular through holes 74*a* and 74*b* are formed to reduce weight without decreasing the strength of the reinforcing frame 70. In parts of the second side plate 73 excluding the second recess 73*b* (parts in both sides of the second recess 73*b* in length direction), two circular through holes 75*a* and 75*b* are formed to reduce weight without decreasing the strength of the reinforcing frame 70.

The reinforcing frame 70 may be embedded in the resin housing 10 as a whole, or both side surfaces 76*a* and 76*b* of the first side plate 72, both side surfaces 77*a* and 77*b* of the second side plate 73, and both side surfaces 78*a* and 78*b* of the base plate 71 may be partially or entirely exposed.

The reinforcing frame 70 is disposed to outwardly surround the box-shaped stopper 60 (insulating space 61) and the cylinder 30 with spacing, such that the base plate 71 is in the second end 12 side, and the tip end 72*a* of the first side plate 72 and the tip end 73*a* of the second side plate 73 are in the first end 11 side.

Moreover, the reinforcing frame 70 is disposed such that the first connection portion 51 and the second connection portion 52 of the conductor piece 50 respectively extend across the first recess 72*b* and the second recess 73*b*. For this reason, the first connection portion 51 and the second connection portion 52 of the conductor piece 50 do not come into contact with the first side plate 72 and the second side plate 73 of the reinforcing frame 70.

The discharge path 64 for combustion products formed in the bottom surface 62 of the box-shaped stopper 60 communicates with the gas passage hole 71*a* formed in the base plate 71 of the reinforcing frame 70, and the gas passage hole 71*a* also faces the cylindrical space 13 in the second end 12 side. Hence, these portions form a discharge path for combustion products formed between the insulating space 61 and the second end 12 of the housing. In other words, the gas passage hole 71*a* of the base plate 71 forms a part of the discharge path for combustion products.

The electric circuit breaker device 1 shown in FIG. 1 can be assembled in the same manner as the electric circuit breaker device 1 shown in FIG. 1 of JP-A 2016-85947. Note, however, that the housing 10 can be produced by performing injection molding (insert molding) with the reinforcing frame 70 placed inside a mold.

A gap allowing passage of combustion products including combustion gas generated by actuation of the igniter 20 may be formed between an inner circumferential surface of the cylinder 30 and an outer circumferential surface of the rod 41 of the projectile 40.

In the electric circuit breaker device 1 shown in FIG. 1, the cylinder 30 and the reinforcing frame 70 made of metal or the like are disposed inside the housing 10 to reinforce the resin housing 10. Hence, the thickness of the resin housing 10 can be reduced, and the entire device can be downsized. In the electric circuit breaker device 1 shown in FIG. 1, the thickness of the housing 10 can be reduced by about 30 to 80% as compared to cases where the cylinder 30 and the reinforcing frame 70 are not used.

Next, an operation will be described of a case where the electric circuit breaker device 1 shown in FIG. 1 is disposed in a part of an electric circuit of an electric vehicle. The electric circuit breaker device 1 shown in FIG. 1 may be combined with a sensor or the like that detects abnormal currents, and may automatically start operation when an abnormal current flows in an electric circuit, for example, or may be actuated manually.

To dispose the electric circuit breaker device 1 in an electric circuit, the electric circuit breaker device 1 is connected with a lead wire forming the electric circuit at the hole 51*a* in the first connection portion 51 and the hole 52*a* in the second connection portion 52 of the conductor piece 50. When an abnormality occurs in the electric circuit, the igniter 20 is actuated, and combustion products are generated from the ignition portion 21.

Since the ignition portion 21 is surrounded by the first end opening 31 side of the cylinder 30, the generated combustion products move straight through the cylinder 30, and collide with the rod 41 of the projectile 40. Thus, the high-temperature combustion products move through the cylinder 30 made of metal or the like and collide with the projectile 40, whereby the inner wall surface 13*a* of the cylindrical space 13 is not directly exposed to heat and pressure of the combustion products.

Moreover, since the reinforcing frame 70 is disposed in the resin housing 10, resistance to internal pressure at the time of actuation is improved, and long-term (life expectancy of electric vehicle) durability is also improved. Thus, since the cylinder 30 and the reinforcing frame 70 are provided, the thickness of the resin housing 10 can be reduced, and the device 1 itself can be downsized.

Upon receipt f the pressure of the combustion product, the projectile 40 moves in the axial direction, and cuts the cutting portion 53 of the conductor piece 50 with the tip end enlarged-diameter portion 42. Then, as shown in FIG. 4, the tip end enlarged-diameter portion 42 and the cut piece 50*a* of the cutting portion 53 move into the insulating space 61, and are held in an electrically insulated manner. With this operation, the first connection portion 51 and the second connection portion 52 at both ends of the conductor piece 50 are electrically interrupted, and the electric circuit in which the device 1 is disposed is broken.

In such a process, a part of the combustion products generated from the igniter 20 passes between the cylinder 30 and the projectile 40 to arrive at the insulating space 61, and thereafter passes through the discharge path for combustion products (the discharge path 64 for combustion products, the gas passage hole 71*a*, and the cylindrical space 13 on the second end 12 side) to be discharged to the outside.

After the conductor piece 50 is cut at the cutting portion 53, even if an arc is generated between the first connection portion 51 and the second connection portion 52, the arc is promptly extinguished by the combustion products discharged through the discharge path for combustion products. Hence, there is no electrical conduction between the first connection portion 51 and the second connection portion 52, and peripheral members are not fused.

Note that since the combustion products discharged from the discharge path are only a small amount, the combustion products do not affect the cutting of the cutting portion 53 by the movement of the bar-shaped projectile 40. The output of the igniter 20 can also be adjusted by taking into account the discharged amount of combustion products according to need.

INDUSTRIAL APPLICABILITY

The electric circuit breaker device of the present invention can be arranged in various electric circuits, and is particularly appropriate for an electric circuit including an automobile battery (e.g., lithium ion battery), an electric circuit of an electric vehicle, and an electric circuit of home appliances.

REFERENCE SIGNS LIST

1 electric circuit breaker device
10 housing
13 cylindrical space
20 igniter
30 cylinder
40 projectile
41 rod
42 tip end enlarged-diameter portion
50 conductor piece
51 first connection portion
52 second connection portion
53 cutting portion
54*a*, 54*b* first fragile portion
55*a*, 55*b* second fragile portion
60 box-shaped stopper
63 discharge path for combustion products
70 reinforcing frame
71 base plate
71*a* gas passage hole
72 first side plate
72*b* first recess
73 second side plate
73*b* second recess

The invention claimed is:

1. An electric circuit breaker device, comprising:
a housing made of a synthetic resin;
an igniter;
a bar-shaped projectile made of a synthetic resin;
a conductor piece forming a part of an electric circuit, the igniter, the bar-shaped projectile, and the conductor being disposed in this order from a first end side of the housing to an axially opposite second end side of the housing; and
an insulating space formed between the second end of the housing and the conductor piece,
the conductor piece being a plate piece comprising a first connection portion and a second connection portion at opposite ends and an intermediate cutting portion, with a surface of the cutting portion being disposed orthogonal to the axial direction of the housing,
the bar-shaped projectile being disposed to oppose the surface of the cutting portion of the conductor piece in the axial direction of the housing,
a cylinder being disposed between the bar-shaped projectile and an inner wall surface of the housing, and
a discharge path for combustion products generated by actuation of the igniter being provided between the insulating space and the second end of the housing,
wherein the cutting portion of the conductor piece has a fragile portion in at least one of a first surface on the first end side and a second surface on the second end side.

2. The electric circuit breaker device according to claim 1, wherein
the cylinder is selected from those made of stainless steel, aluminum, and a carbon-fiber reinforced resin.

3. An electric circuit breaker device, comprising:
a housing made of a synthetic resin;
an igniter;
a bar-shaped projectile made of a synthetic resin;
a conductor piece to form a part of an electric circuit, the igniter, the bar-shaped projectile, and the conductor piece being disposed in this order from a first end side of the housing to an axially opposite second end side of the housing; and
an insulating space formed between the second end of the housing and the conductor piece,
the conductor piece being a plate piece comprising a first connection portion and a second connection portion at opposite ends and an intermediate cutting portion, with a surface of the cutting portion being disposed orthogonal to the axial direction of the housing, the bar-shaped projectile being disposed to oppose the surface of the cutting portion of the conductor piece in the axial direction of the housing, a cylinder being disposed between the bar-shaped projectile and an inner wall surface of the housing, a reinforcing frame, provided separately from the conductor piece, and being further disposed within the housing outside of the cylinder and the insulating space, and a discharge path for combustion products generated by actuation of the igniter being provided between the insulating space and the second end of the housing.

4. The electric circuit breaker device according to claim 3, wherein:

the reinforcing frame is U-shaped or similarly shaped in plan, and has a base plate including a gas passage hole penetrating in a thickness direction, and a first side plate and a second side plate extending in the same direction from lengthwise opposite ends of the base plate;

the reinforcing frame is disposed to outwardly surround the insulating space and the cylinder with spacing, such that the base plate is in the second end side of the housing, and a tip end of the first side plate and a tip end of the second side plate are in the first end side of the housing; and the gas passage hole of the base plate forms a part of the discharge path for combustion products.

5. The electric circuit breaker device according to claim 3, wherein:

the reinforcing frame is U-shaped or similarly shaped in plan, and has a base plate including a gas passage hole penetrating in a thickness direction, and a first side plate and a second side plate extending in the same direction from lengthwise opposite ends of the base plate;

the first side plate is narrowed between the base plate and the tip end to have a first recess, and the second side plate is narrowed between the base plate and the tip end to have a second recess, the first recess and the second recess being formed at opposing positions;

the reinforcing frame is disposed to outwardly surround the insulating space and the cylinder with spacing, such that the base plate is in the second end side of the housing, a tip end of the first side plate and a tip end of the second side plate are in the first end side of the housing, and further, the first connection portion and the second connection portion of the conductor piece extend across the first recess and the second recess; and the gas passage hole of the base plate forms a part of the discharge path for combustion products.

6. The electric circuit breaker device according to claim 3, wherein the reinforcing frame has a hole penetrating in the thickness direction in a part of the first side plate excluding the first recess, and in a part of the second side plate excluding the second recess.

7. The electric circuit breaker device according to claim 3, wherein the reinforcing frame is selected from those made of stainless steel, aluminum, and a carbon-fiber reinforced resin.

8. The electric circuit breaker device according to claim 3, wherein the cylinder is selected from those made of stainless steel, aluminum, and a carbon-fiber reinforced resin.

9. The electric circuit breaker device according to claim 3, wherein the cutting portion of the conductor piece has a fragile portion in at least one of a first surface on the first end side and a second surface on the second end side.

10. The electric circuit breaker device according to claim 4, wherein the reinforcing frame has a hole penetrating in the thickness direction in a part of the first side plate excluding the first recess, and in a part of the second side plate excluding the second recess.

11. The electric circuit breaker device according to claim 5, wherein the reinforcing frame has a hole penetrating in the thickness direction in a part of the first side plate excluding the first recess, and in a part of the second side plate excluding the second recess.

12. The electric circuit breaker device according to claim 4, wherein the reinforcing frame is selected from those made of stainless steel, aluminum, and a carbon-fiber reinforced resin.

13. The electric circuit breaker device according to claim 5, wherein the reinforcing frame is selected from those made of stainless steel, aluminum, and a carbon-fiber reinforced resin.

14. The electric circuit breaker device according to claim 6, wherein the reinforcing frame is selected from those made of stainless steel, aluminum, and a carbon-fiber reinforced resin.

15. The electric circuit breaker device according to claim 4, wherein the cylinder is selected from those made of stainless steel, aluminum, and a carbon-fiber reinforced resin.

16. The electric circuit breaker device according to claim 5, wherein the cylinder is selected from those made of stainless steel, aluminum, and a carbon-fiber reinforced resin.

17. The electric circuit breaker device according to claim 6, wherein the cylinder is selected from those made of stainless steel, aluminum, and a carbon-fiber reinforced resin.

18. The electric circuit breaker device according to claim 7, wherein the cylinder is selected from those made of stainless steel, aluminum, and a carbon-fiber reinforced resin.

19. An electric circuit breaker device, comprising:

a housing made of a synthetic resin;

an igniter;

a bar-shaped projectile made of a synthetic resin; and a conductor piece forming a part of an electric circuit, the igniter, the bar-shaped projectile, and the conductor being disposed in this order from a first end side of the housing to an axially opposite second end side of the housing, an insulating space being formed between the second end of the housing and the conductor piece, the conductor piece being a plate piece comprising a first connection portion and a second connection portion at opposite ends and an intermediate cutting portion, with a surface of the cutting portion being disposed orthogonal to the axial direction of the housing, the bar-shaped projectile being disposed to oppose the surface of the cutting portion of the conductor piece in the axial direction of the housing, a cylinder being disposed between the bar-shaped projectile and an inner wall surface of the housing, and a discharge path for combustion products generated by actuation of the igniter being provided between the insulating space and the second end of the housing, wherein the cutting portion of the conductor piece has a first fragile portion in a first surface on the first end side, and a second fragile portion in a second surface on the second end side; and of the first surface having the first fragile portion and the second surface having the second fragile portion, the second surface has a smaller strength.

* * * * *